US007659656B2

(12) United States Patent
Knorr

(10) Patent No.: US 7,659,656 B2
(45) Date of Patent: Feb. 9, 2010

(54) VEHICLE HEADLIGHT BULB

(75) Inventor: Klaus-Peter Knorr, Nennslingen (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 0 days.

(21) Appl. No.: 10/588,436

(22) PCT Filed: Jan. 31, 2005

(86) PCT No.: PCT/DE2005/000144

§ 371 (c)(1),
(2), (4) Date: Aug. 7, 2006

(87) PCT Pub. No.: WO2005/076317

PCT Pub. Date: Aug. 18, 2005

(65) Prior Publication Data

US 2007/0159840 A1 Jul. 12, 2007

(30) Foreign Application Priority Data

Feb. 9, 2004 (DE) ..... 10 2004 006 439

(51) Int. Cl.
*H01J 5/48* (2006.01)
*F21V 14/00* (2006.01)

(52) U.S. Cl. ..... 313/318.01; 313/318.09; 362/255

(58) Field of Classification Search ..... 362/255, 362/507, 549; 313/318.01, 318.09, 634, 313/318.05, 318.1
See application file for complete search history.

(56) References Cited

U.S. PATENT DOCUMENTS

| | | | | |
|---|---|---|---|---|
| 4,634,920 | A | 1/1987 | Rijckaert et al. | |
| 4,769,574 | A | 9/1988 | Nagasawa et al. | |
| 4,843,276 | A * | 6/1989 | Jacrot | 313/318.07 |
| 6,215,236 | B1 * | 4/2001 | Gotoh et al. | 313/318.07 |
| 6,250,970 | B1 | 6/2001 | Key et al. | |
| 7,224,111 | B2 * | 5/2007 | Kling et al. | 313/234 |
| 7,456,560 | B2 * | 11/2008 | Knorr | 313/318.01 |

FOREIGN PATENT DOCUMENTS

| | | |
|---|---|---|
| DE | 19 84 184 U | 4/1968 |
| EP | 1 058 356 A | 12/2000 |
| GB | 1 214 736 A | 12/1970 |
| JP | 10040877 A | 2/1998 |
| JP | 10079238 A | 3/1998 |

OTHER PUBLICATIONS

English Abstract of JP10079238.
English Abstract of JP10040877.

* cited by examiner

*Primary Examiner*—John A Ward

(57) ABSTRACT

The invention relates to a vehicle headlight bulb comprising a bulb socket, an illuminant (2) arranged inside the bulb socket (1), and a base comprising a metallic sleeve (3) in which a sealed end (11) of the socket (1) is fixed. According to the invention, at least one of the narrow front sides (111) of the sealed end (11) of the socket (1) is provided with a serrated profiled element (1110) which extends in the longitudinal direction of the bulb and forms a latch connection with at least one locking plate (33) formed on the base sleeve (3).

5 Claims, 7 Drawing Sheets

VEHICLE HEADLIGHT BULB

The invention relates to a vehicle headlight bulb according to the preamble of claim 1.

I. PRIOR ART

Such a vehicle headlight bulb is disclosed, for example, in Offenlegungsschrift EP 0 235 855 A1. This document describes a halogen incandescent lamp of the H1 type which is used for generating the dipped or main beam in vehicle headlights. This halogen incandescent lamp has a lamp envelope with a coiled filament arranged therein and a lamp base which has a metallic sleeve in which a sealed end of the lamp envelope is fixed.

II. BRIEF DESCRIPTION OF THE INVENTION

It is the object of the invention to provide a vehicle headlight bulb with an improved holder of the lamp envelope in the lamp base.

According to the invention, this object is achieved by the features of claim 1. Particularly advantageous embodiments of the invention are described in the dependent claims.

The vehicle headlight bulb according to the invention has a lamp envelope, a light source arranged inside the lamp envelope and a lamp base, the lamp envelope having a sealed end with two mutually opposite broad faces and two mutually opposite narrow end faces and the lamp base having a metallic base sleeve in which the sealed end of the lamp envelope is fixed. According to the invention, at least one of the narrow end faces and the metallic base sleeve are provided with matching means for a latch connection. This ensures reliable anchoring of the lamp envelope in the metallic base sleeve. In particular, the aforementioned latch connection prevents the lamp envelope, after having been inserted into the base sleeve, being able to be pulled out of the base sleeve again against the direction of its insertion. The means for the aforementioned latch connection advantageously comprise at least one notch which is arranged in the at least one narrow end face of the pinched seal, and a wall area of the base sleeve engaging in the former. This makes it possible to implement a latch connection in a simple and cost effective manner. The wall area of the base sleeve engaging in the at least one notch is preferably constructed as a locking plate directed into the interior space of the base sleeve, which rests against the pinched seal of the lamp envelope in the area of the at least one notch. In addition to the latch connection, a spring effect is achieved by means of the locking plate. Due to the spring effect of the locking plate, the two narrow sides of the pinched seal are arranged with press fit in the base sleeve. The at least one narrow end face of the pinched seal preferably has a number of notches which form a serrated profile extending in the longitudinal direction of the pinched seal, and the base sleeve preferably has a number of locking plates in order to ensure that at least one of the locking plates latches into a notch of the serrated profile during the assembly of the pinched seal in the base sleeve. Instead of the aforementioned locking plates, the base sleeve can have bulges pointing into the interior space which engage in the notches at the at least one narrow end face of the pinched seal and form the latch connection. For production reasons, a combination of at least one of the aforementioned locking plates with at least one of the aforementioned bulges in the base sleeve wall may be advantageous in order to form a latch connection with the notches in the at least one narrow end face of the pinched seal.

To provide better heat removal, the metallic base sleeve is advantageously provided with at least one opening in the area of the broad faces of the sealed end of the lamp envelope. This reduces the thermal loading on the sealed end of the lamp envelope during lamp operation.

The metallic base sleeve is advantageously equipped with at least two plates which are molded on two mutually opposite edges of the aforementioned at least one opening and rest against one of the broad faces of the sealed end of the lamp envelope in order to achieve a press fit of the two broad faces of the sealed end of the lamp envelope in the base sleeve. The broad face against which at least two plates rest is advantageously provided with at least two molded-on guide webs extending in the longitudinal direction of the lamp which serve as stop for one of the two plates in each case. The guide webs ensure a precise alignment of the lamp envelope with respect to the base sleeve.

III. DESCRIPTION OF THE PREFERRED EXEMPLARY EMBODIMENT

In the text which follows the invention will be explained in greater detail with reference to a preferred exemplary embodiment. In the figures.

Figure 1:
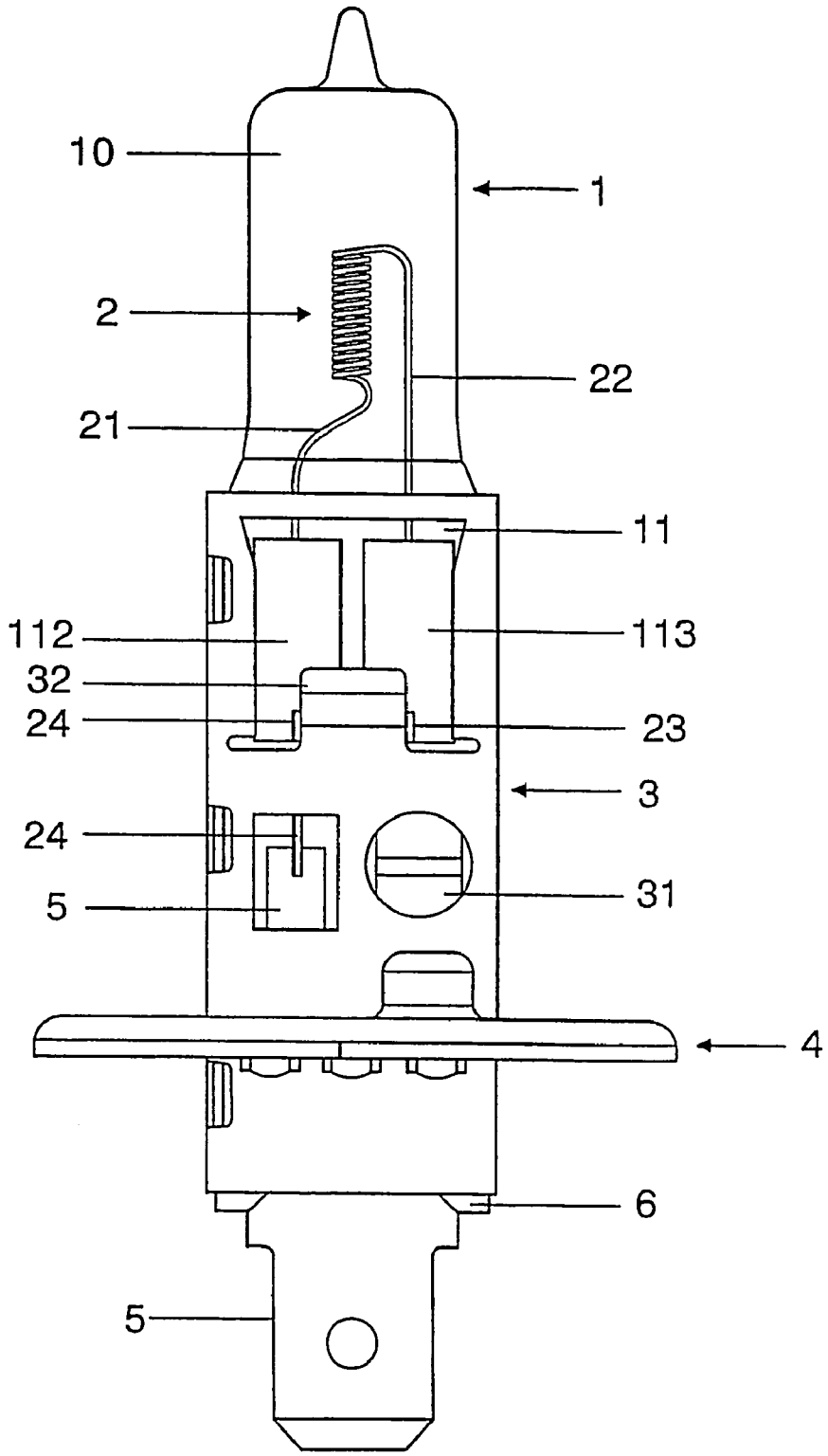
FIG. 1 shows a side view of a vehicle headlight bulb according to the preferred exemplary embodiment of the invention
Figure 2:
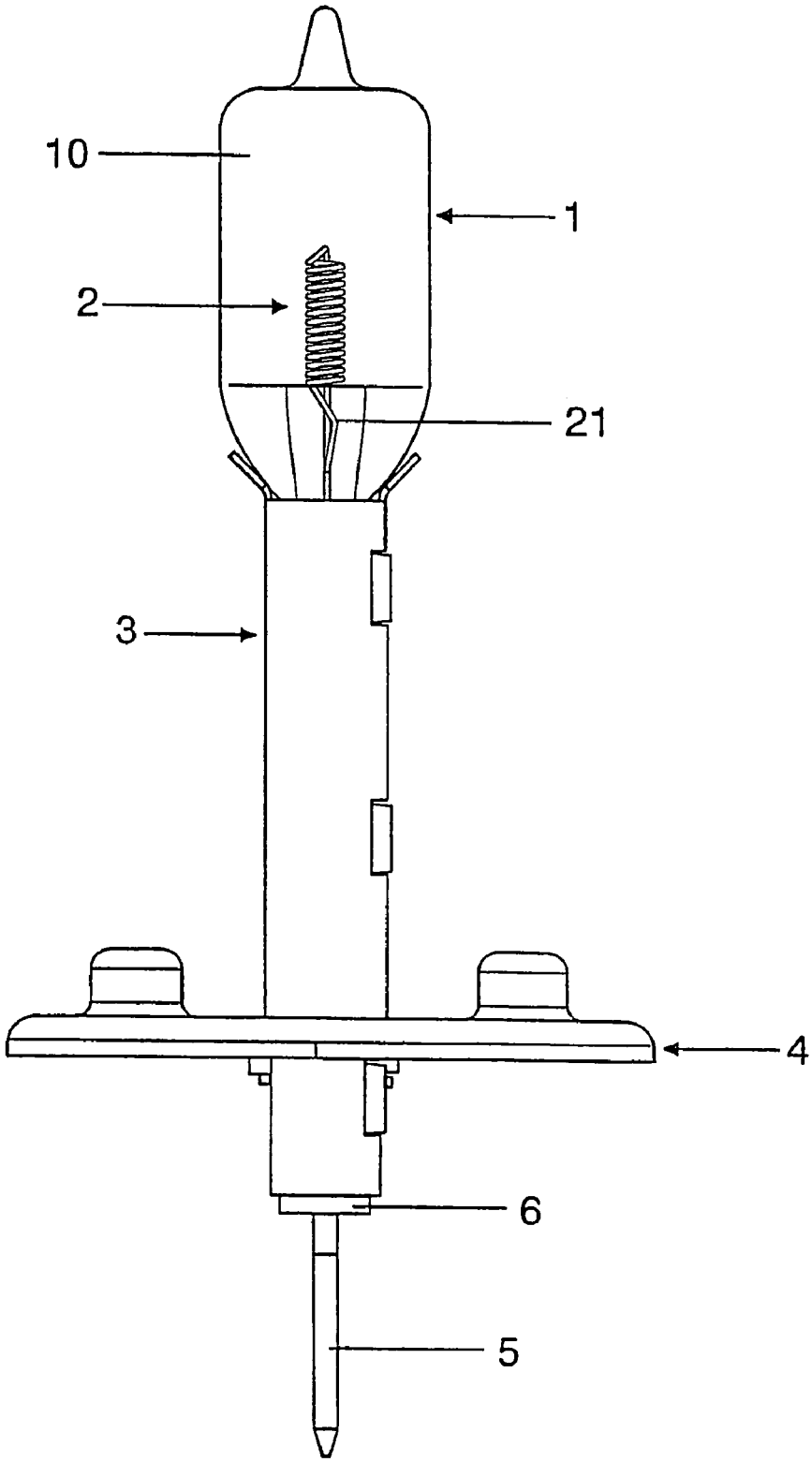
FIG. 2 shows the vehicle headlight bulb shown in FIG. 1 in a side view rotated by 90 degrees with respect to the lamp axis with respect to the side view of FIG. 1

The preferred exemplary embodiment of the invention shown in FIGS. 1 to 7 is a halogen incandescent lamp of type H1 bulb which can be used in vehicle headlights for generating the dipped beam, the main beam or the fog light beam.

This bulb has an essentially cylindrical lamp envelope 1 of quartz glass which has an essentially circularly cylindrical inside space 10 and is closed at one end by means of a pinched seal 11. In the inside space 10 of the lamp envelope 1, an axially aligned coiled filament 2 is arranged, the ends of which are in each case welded to a molybdenum foil 112, 113 via an inner supply lead 21, 22 of tungsten in each case. The molybdenum foils 112, 113 are part of the pinched seal 11 which is constructed as a molybdenum foil seal. They are embedded in a gas-tight manner in the pinched base 11. From the pinched base 11, two supply lead wires 23, 24 consisting of molybdenum protrude which are in each case welded to one of the molybdenum foils 112 and 113, respectively, and are used for supplying the coiled filament 2 with current. The pinched base 11 is fixed with press fit in a metallic base sleeve 3. The base sleeve 3 has an opening 30 in each case at two opposite side walls in the area of the pinched base 11, so that the broad faces 110 of the pinched base 11 are essentially not covered by the base sleeve 3 in the area of the molybdenum foils 112, 113 in order to not impede the heat radiation from the broad faces 110 of the pinched base 11. The base sleeve 3 essentially only encloses the narrow end faces 111 of the pinched base 11. The base sleeve 3 has two plates 32 which in each case extend into one of the openings 30 and rest against the pinched base 11 in the area of overlap of the supply lead wires 23, 24 with the molybdenum foils 112, 113. These plates 32 are in each molded on to one edge of the respective opening 30 in the base sleeve 3. They are used as cooling plates for reducing the thermal loading on the welds between the supply lead wires 23, 24 and the molybdenum foils 112, 113.

The supply lead wire 23 is electrically conductively connected to a contact tab 31 molded on to the base sleeve 3 and pointing into the inside space of the base sleeve 3. The base sleeve 3, and thus also the supply lead wire 23 and the inner supply lead 22, are at ground potential, for example, during lamp operation. The opposite electrical pole to this is formed by the contact tab 5 which is electrically conductively connected to the supply lead wire 24 and is electrically insulated from the base sleeve 3 by means of the base insulator 6 consisting of ceramic. On the base sleeves 3, an annular base flange 4 is attached which is used for aligning and assembling the H1 bulb in a vehicle headlight. The lamp base consists of the base flange 4, the base sleeve 3, the base insulator 6 and the contact tab 5. The base sleeve 3 preferably consists of stainless steel or of brass. The base flange 4 consists of nickel silver and the contact tab 5 consists of stainless steel. FIGS. 2 to 7 show details of the lamp base and of the lamp envelope 1.

Figure 3:
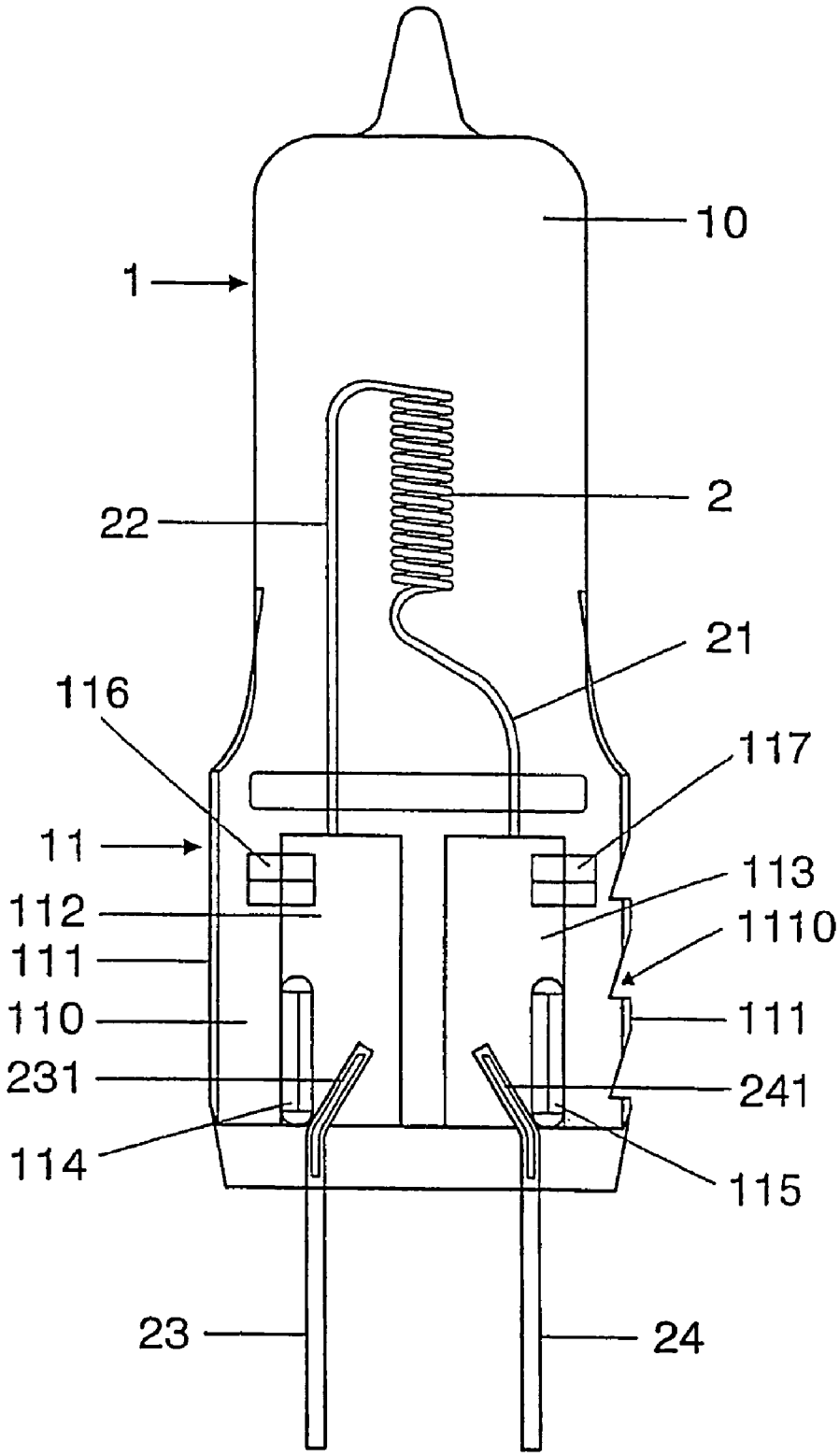
FIG. 3 shows a side view of the lamp envelope of the vehicle headlight bulb shown in FIG. 1

FIG. 3 shows details of the lamp envelope 1 and of the pinched seal 11. The pinched seal 11 has two mutually opposite broad faces 110 and two mutually opposite narrow end faces 111. It is essentially constructed to be cuboid. The molybdenum foils 112, 113 welded to the inner supply leads 21, 22 and the supply lead wires 23, 24 are embedded in a gas-tight manner in the pinched base 11. The angled-away ends 231, 241 of the supply lead wires 23, 24 overlap with the molybdenum foils 112 and 113, respectively, and are welded to the molybdenum foils 112 and 113, respectively. In this overlap area, the two plates 32 rest against the broad faces 110 of the pinched seal 11 so that the pinched seal 11 is arranged with press fit between the two plates 32. One of the two narrow end faces 111 of the pinched seal 11 is provided with a serrated profile consisting of three notches 1110, extending in the longitudinal direction of the bulb or of the lamp vessel 1, respectively. Together with at least one of the three locking plates 33 shown in FIG. 4, which are molded on to the base sleeve 3 and extend in the inside space of the base sleeve 3, this profile 1110 forms a latch connection. After the pinched seal 11 has been inserted into the base sleeve, the locking plates 33 latch behind the teeth of the serrated profile 1110 and prevent the pinched seal 11 from being able to be pulled out of the base sleeve 3 again. The locking plates 33 are constructed to be elastic so that the narrow end faces 111 of the pinched seal 11 are also arranged with press fit in the base sleeve 3. Each of the two broad faces 110 of the pinched seal 11 is equipped with a molded-on pair of guide webs 114, 115, extending in the longitudinal direction of the bulb or of the lamp envelope 1, respectively, which in each case interact with a pair of plates 34, 35 molded on to the base sleeve 3 in order to provide for precise alignment of the lamp envelope 1 with respect to the base sleeve 3. The plates 34, 35 are in each case molded on to two opposite edges, extending in the longitudinal direction of the bulb, of the openings 30 arranged in the area of the pinched seal 11 and rest against the broad faces 110 of the pinched seal 11 with press fit. The guide webs 114, 115 serve as a stop for the free ends of the plates 34, 35. Two pairs of knobs 116, 117 molded on to the broad faces 110 of the pinched seal 11 interact with in each case one guide plate 361 which are molded on to the metallic base sleeve 3 and extend into the opening 30, in order to ensure accurate alignment and guidance of the pinched seal 11 in the base sleeve 3.

Figure 4:
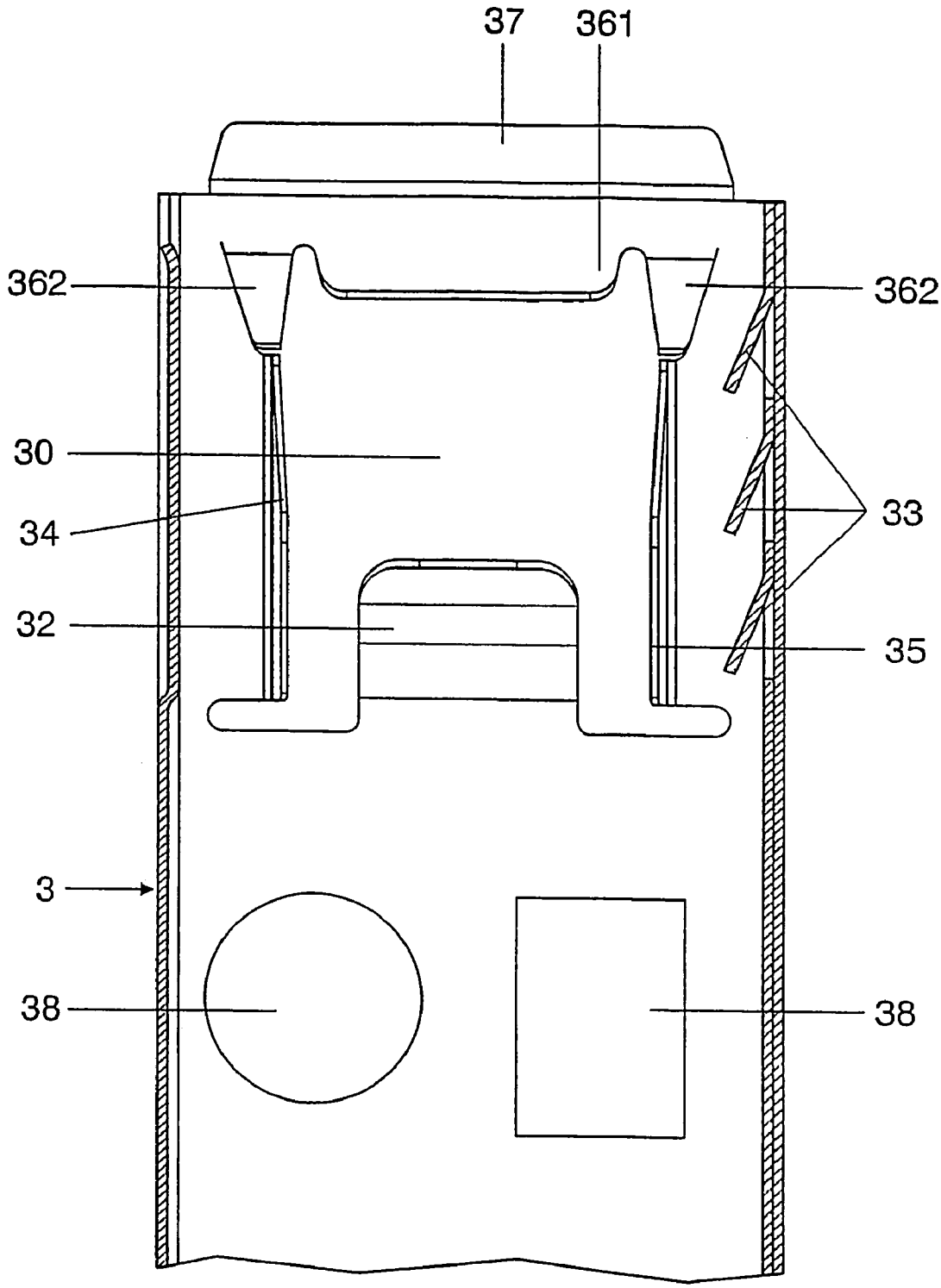
FIG. 4 shows a side view in partial section of a section of the base sleeve of the vehicle headlight bulb shown in FIG. 1
Figure 5:
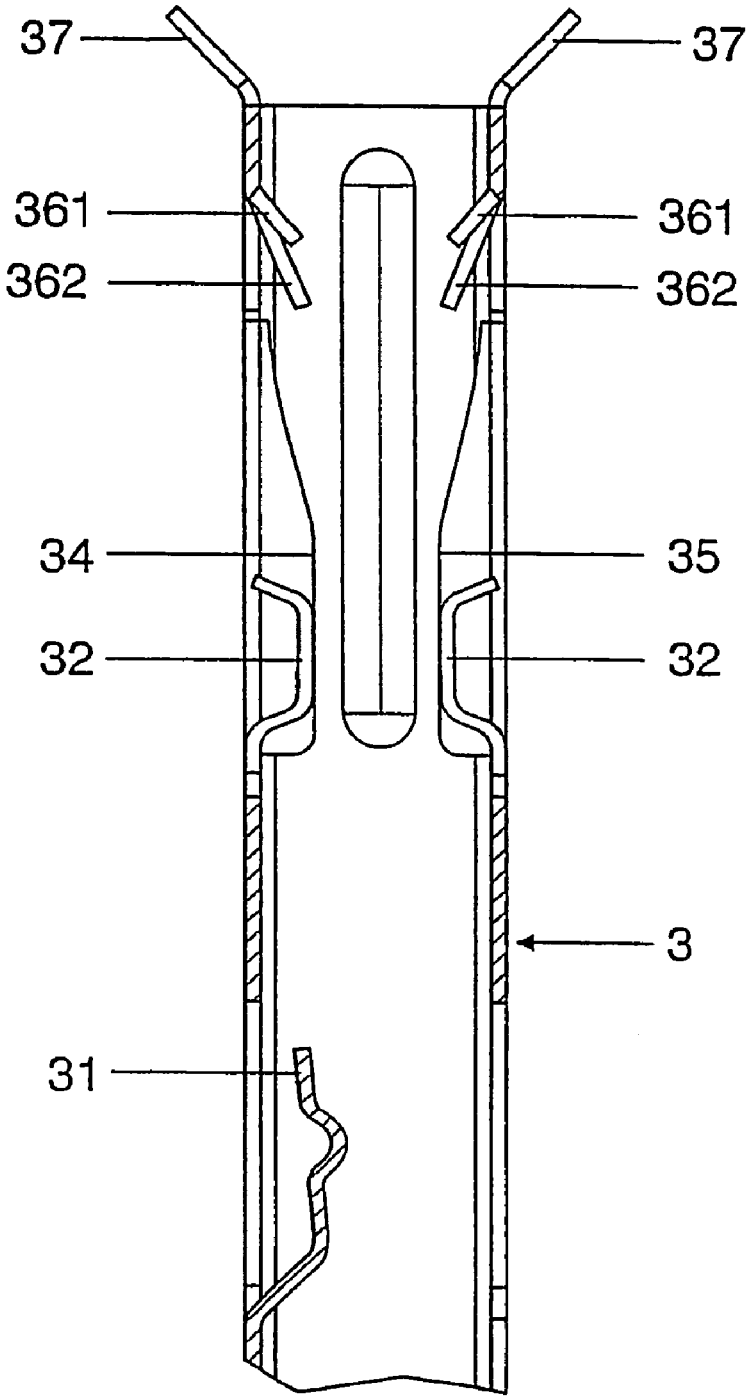
FIG. 5 shows the section, shown in FIG. 4, of the base sleeve in a side view rotated by 90 degrees with respect to FIG. 4 and shown in section

Details of the base sleeve 3 are shown in FIGS. 4 and 5. The base sleeve 3 has four more mounting plates 362 which rest against the broad faces of the pinched seal 11 with press fit in the area of the openings 30. In addition, the base sleeve 3 has two molded-on shielding plates 37 which shield the lamp base against the light emitted by the coiled filament 2. The essentially cuboid base sleeve 3 has on two opposite sides in each case two recesses 38 which are used for welding the supply lead wires 23, 24 to the contact plate 31 or the contact tab 5, respectively.

Figure 6:
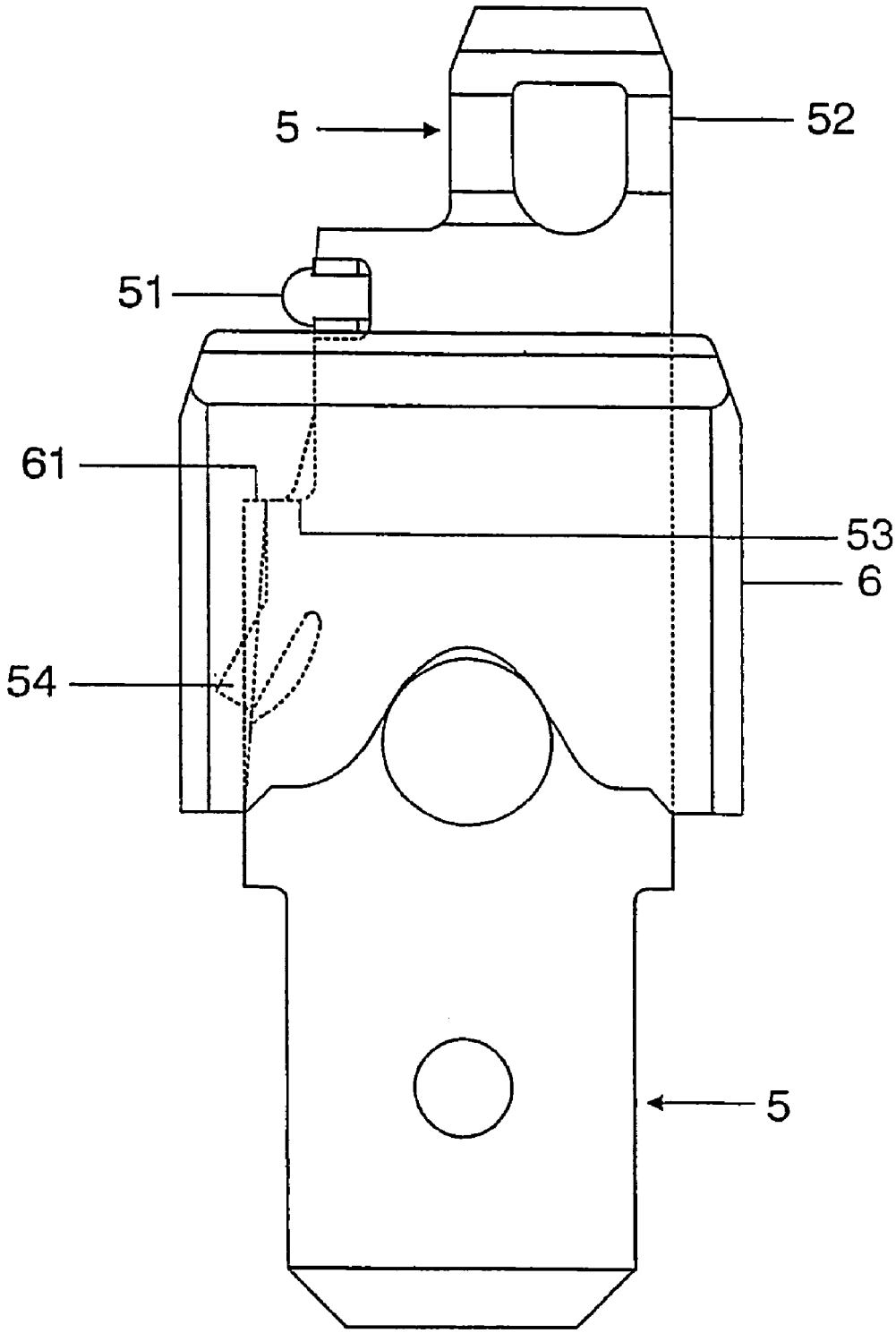
FIG. 6 shows a side view of the contact tab and of the base insulator of the vehicle headlight bulb shown in FIG. 1
Figure 7:
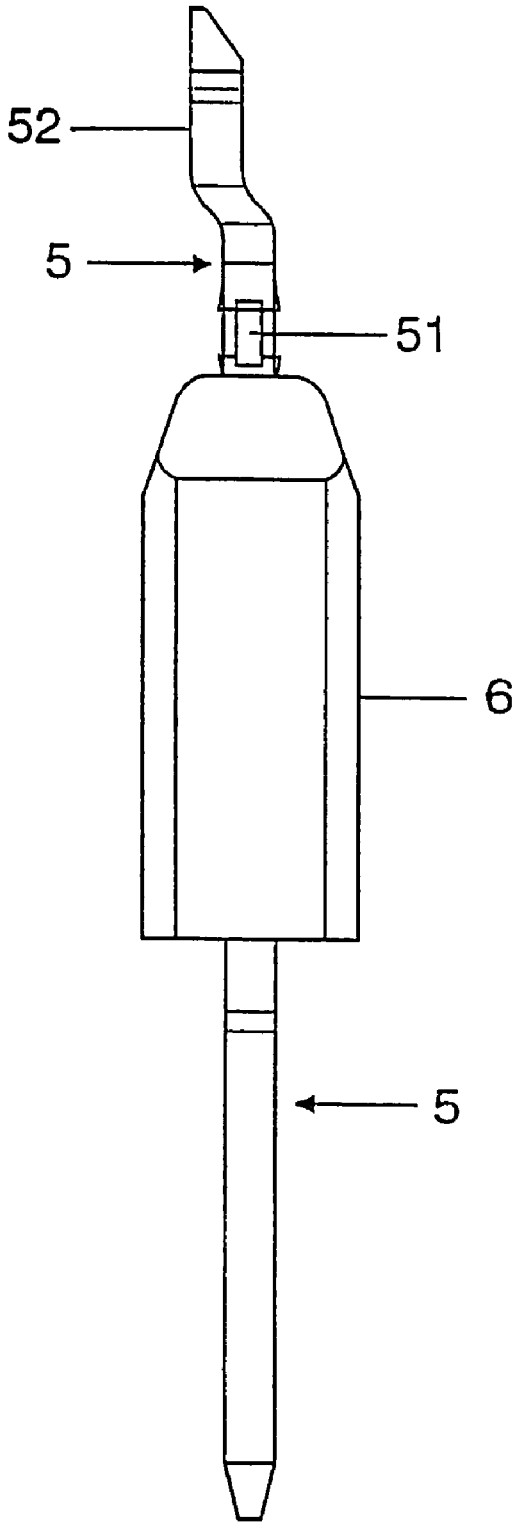
FIG. 7 shows the contact tab, shown in FIG. 6, with base insulator in a side view rotated by 90 degrees with respect to FIG. 6.

FIGS. 6 and 7 show details of the contact tab 5 and of the base insulator 6. The contact tab 5 is fixed with press fit in the hollow base insulator 6. Both ends of the contact tab 5 protrude out of the base insulator 6. In the interior of the base insulator 6, a step 61 is located on which rests a shoulder 53 of the contact tab 5. The welding plate 52 protruding from the base insulator 6 is provided with a flattening 51 or offset which interacts with the shoulder 53 and the step 61 in order to ensure the press fit of the contact tab 5 in the base insulator 6. The welding plate 52 of the contact tab 5 is welded to the supply lead wire 24 after the constructional unit consisting of the base insulator 6 and the contact tab 5 has been inserted in the base sleeve 3. To anchor the contact tab 5 in the base insulator 6, the contact tab 5 has a spring plate 54 molded on to one side edge and spread away from it, which ensures a press fit of the contact tab 5 in the base insulator 6.

The invention claimed is:

1. A vehicle headlight bulb comprising a lamp envelope, a light source arranged inside the lamp envelope, and a lamp base, wherein the lamp envelope has a sealed end which is essentially constructed to be cuboid formed by two mutually opposite broad faces and two mutually opposite narrow end faces, the lamp base has a metallic sleeve in which said sealed end of the lamp envelope is fixed, at least one of the narrow end faces of the sealed end and the metallic base sleeve are provided with matching means for a latch connection, and the metallic base sleeve has at least one opening in the area of the broad faces of said sealed end of the lamp envelope, wherein the metallic base sleeve has at least two plates which are molded on to two mutually opposite edges of said opening and rest against one of said broad faces of the sealed end of the lamp envelope, and wherein said sealed end is equipped with a molded-on pair of guide webs extending in the longitudinal direction of the lamp envelope, respectively, said guide webs sewing as a stop for the free ends of said at least two plates.

2. The vehicle headlight bulb as claimed in claim 1, wherein the at least one narrow end face is provided with at least one notch and the metallic base sleeve is equipped with a wall area engaging in the former.

3. The vehicle headlight bulb as claimed in claim 2, wherein the wall area is at least one locking plate pointing into the inside space of the base sleeve.

4. The vehicle headlight bulb as claimed in claim 2, wherein the wall area is constructed as at least one bulge, pointing into the inside space of the base sleeve, in the base sleeve wall.

5. The vehicle headlight bulb as claimed in claim 1, wherein the broad face of the sealed end of the lamp envelope is provided with at least two molded-on guide webs extending in the longitudinal direction of the vehicle headlight bulb, which serve as a stop for in each case one of the two plates.

* * * * *